US005657912A

United States Patent [19]

Nakayama

[11] Patent Number: 5,657,912

[45] Date of Patent: Aug. 19, 1997

[54] WAIST BAG USABLE AS A BABY HOLDER

[76] Inventor: Kuniko Nakayama, 15 Banchi, Kuruwamachihigashi 2-chome, Ogakishi, Gifu, Japan

[21] Appl. No.: 625,250

[22] Filed: Apr. 1, 1996

Related U.S. Application Data

[63] Continuation of Ser. No. 341,921, Nov. 16, 1994, abandoned.

[30] Foreign Application Priority Data

May 20, 1994 [JP] Japan ..... 6-004720 U

[51] Int. Cl.[6] ..... A45F 4/02

[52] U.S. Cl. ..... 224/159; 224/161; 224/625; 224/664; 224/235; 224/586; 224/575; 190/903; 383/97

[58] Field of Search ..... 224/159, 158, 224/160, 161, 235, 270, 663, 664, 625, 626, 575; 190/903; 150/118; 383/97

[56] References Cited

U.S. PATENT DOCUMENTS

| | | | |
|---|---|---|---|
| 3,321,120 | 5/1967 | Cunningham | 24/209 |
| 5,195,666 | 3/1993 | Yamaguchi et al. . | |
| 5,209,385 | 5/1993 | Ledesma | 224/224 |
| 5,292,042 | 3/1994 | Yamaguchi et al. . | |
| 5,396,683 | 3/1995 | Ray | 224/253 |

FOREIGN PATENT DOCUMENTS

| | | |
|---|---|---|
| 1-177961 | 12/1989 | Japan . |
| 2-124107 | 5/1990 | Japan . |
| 4-62115 | 5/1992 | Japan . |
| 5-1314 | 1/1993 | Japan . |
| 6-26547 | 4/1994 | Japan . |

*Primary Examiner*—Linda J. Sholl

*Attorney, Agent, or Firm*—Armstrong, Westerman, Hattori, McLeland & Naughton

[57] ABSTRACT

A waist bag usable as a baby holder has a seat member disposed in a bag body and composed of a horizontal plate core and a vertical waist pad. An archshaped mouth has a central region formed in an upper and frontal middle portion of the bag body, and side regions extending from the central region towards lower and rear ends of the opposite sides of the bag body, so that the weight of a seated baby is distributed over the user's body, thus protecting him or her from fatigue during a continued usage of this bag. The waist bag is also improved in that the user can open the mouth wide enough for a shoulder strap or any article to be readily put in or taken out of the bag body.

11 Claims, 3 Drawing Sheets

WAIST BAG USABLE AS A BABY HOLDER

This application is a continuation of application Ser. No. 08/341,921 filed Nov. 16, 1994, now abandoned.

BACKGROUND OF THE INVENTION

1. Field of the Invention

The present invention relates to a waist bag usable as a baby holder.

2. Description of the Prior Art

The waist bags of this kind are known to the public, as disclosed in: the Japanese Utility Model Early Publication Hei. 4-62115 ('Reference 1'); Patent Publication Hei. 2-124107 ('Reference 2'); and Utility Model Early Publication Hei. 1-177961 ('Reference 3').

Each of the prior art waist bags comprises a shoulder strap connected to a bag body, which is reinforced with a rigid plate core disposed under a top sheet of the bag body. When a user suspends the shoulder strap from his or her shoulder or neck, this waist bag serves as a baby holder allowing a baby to sit on the top sheet.

It is however noted that certain drawbacks are inherent in those waist bags usable as baby holders, as will be detailed below.

The waist bag disclosed in Reference 1 comprises the horizontal plate core under the top sheet. The weight of the baby seated on the bag body will be supported by the plate core, which consequently exerts a considerable load to the waist of the user. Therefore, it is not comfortable for the user to continuously use for a long time the waist bag as a baby holder.

Such an uncomfortableness may be relieved to a certain extent in the waist bags of the other types shown in References No. 2 and No. 3. A seat member L-shaped in cross section has a vertical waist pad depending from an edge of the horizontal plate core. The bag body shown in Reference No. 2 has a closable opening formed through and extending horizontally across an upper front portion of said bag body. The vertical waist pad will however prevent the opening from fully opening, thereby rendering the bag body inconvenient for getting the waist band or the like in and out. On the other hand, the bag body shown in Reference No. 3 has a closable opening formed in a bottom sheet. In this case, even small articles can not easily be put in and taken out of the bag body.

SUMMARY OF THE INVENTION

An object of the present invention made in view of such drawbacks is therefore to provide a waist bag usable as a baby holder, which bag is improved in the load distribution so that the weight of a baby seated on a bag body will not cause an intolerable pressure or pain to the waist of a user, thus protecting him or her from fatigue during a continued usage of this bag as the baby holder. The waist bag has to be improved not only in appearance but also in that the user can open a mouth of the bag body wide enough for a shoulder strap or any article to be readily put in or taken out of the bag body.

According to the present invention, the waist bag comprises a bag body having a top sheet, a front sheet and a rear sheet, a waist belt, a seat member disposed in and connected to the bag body, a Y-shaped shoulder strap and a mouth of the bag body which has opposite sides connected to ends of the waist belt. The waist bag is characterized in that the seat member comprises a horizontal plate core extending along the top sheet and a vertical waist pad extending along the rear sheet, and the mouth is arch-shaped to have a central region formed in an upper middle portion of the front sheet, and side regions which extend from the central region towards lower and rear ends of the opposite sides of the bag body. The shoulder strap capable of being suspended from a user's shoulder when the user holds a baby seated on the bag body has a lower end secured to an inner surface of a central portion of the top sheet, so as to be taken from the bag body, through the mouth's middle region.

In use, an essential portion of the weight of the baby sitting on the bag body will spread over the waist pad and be borne by a wider surface of the user's waist, because the seat member consists of the plate core and the waist pad. Concentration of load in the shoulder strap will thus be avoided. By unfastening a zipper closing the mouth, the front sheet of the bag body can be turned downward to open the mouth wide.

DETAILED DESCRIPTION OF THE PREFERRED EMBODIMENTS

Figure 1:
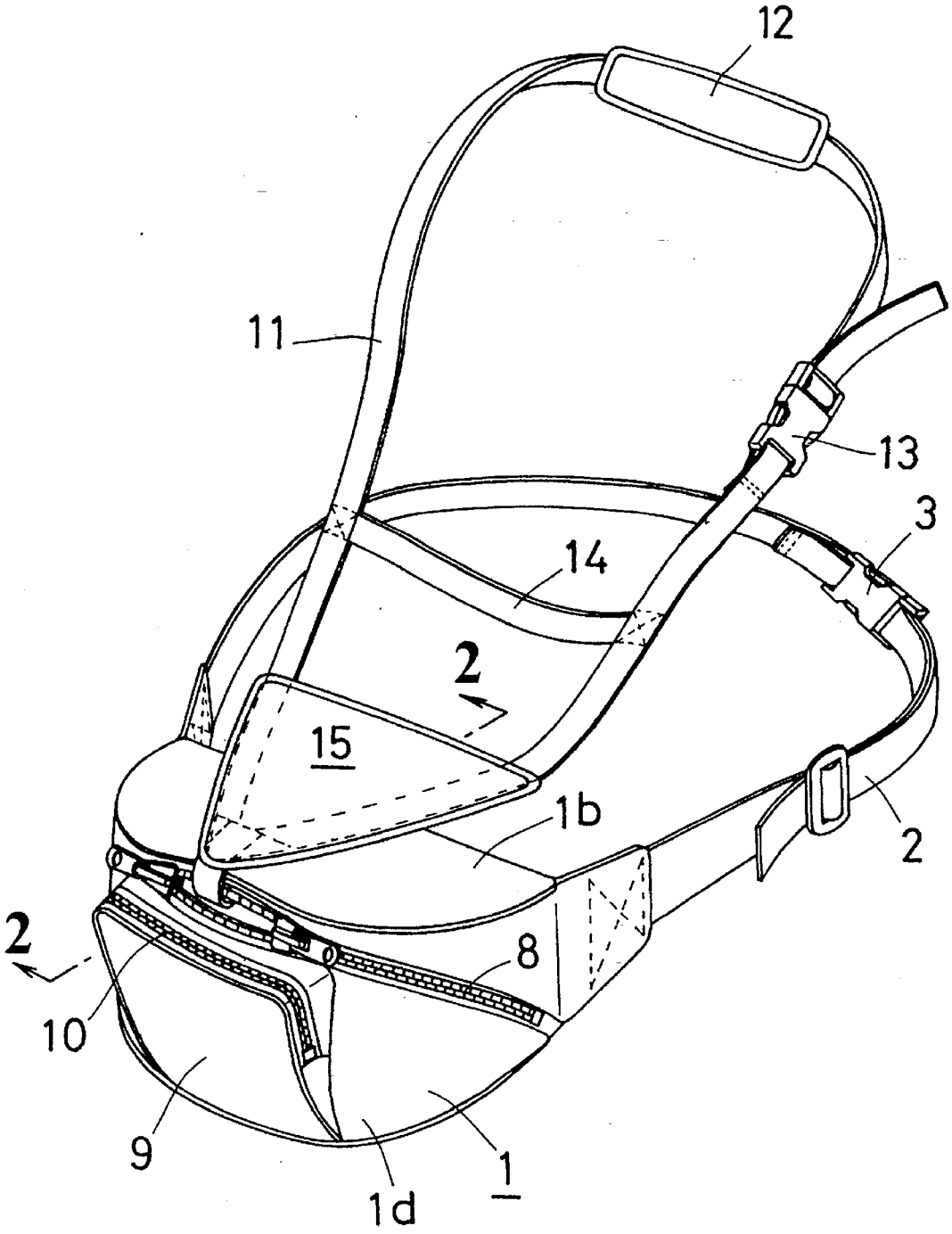
FIG. 1 is a perspective view of a waist bag usable as a baby holder, shown in its entirety, in an embodiment.
Figure 2:
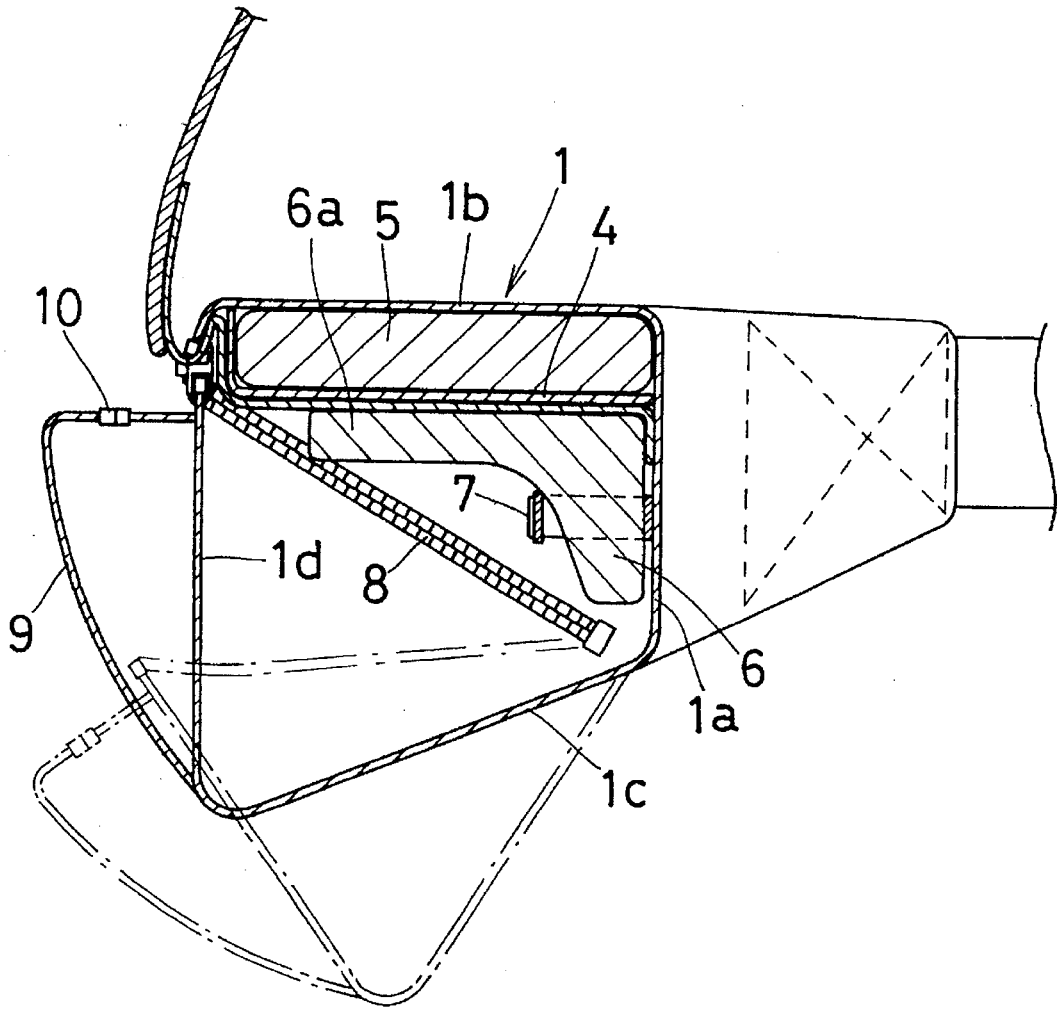
FIG. 2 is a cross section taken along the line 2—2 in FIG. 1.
Figure 3:
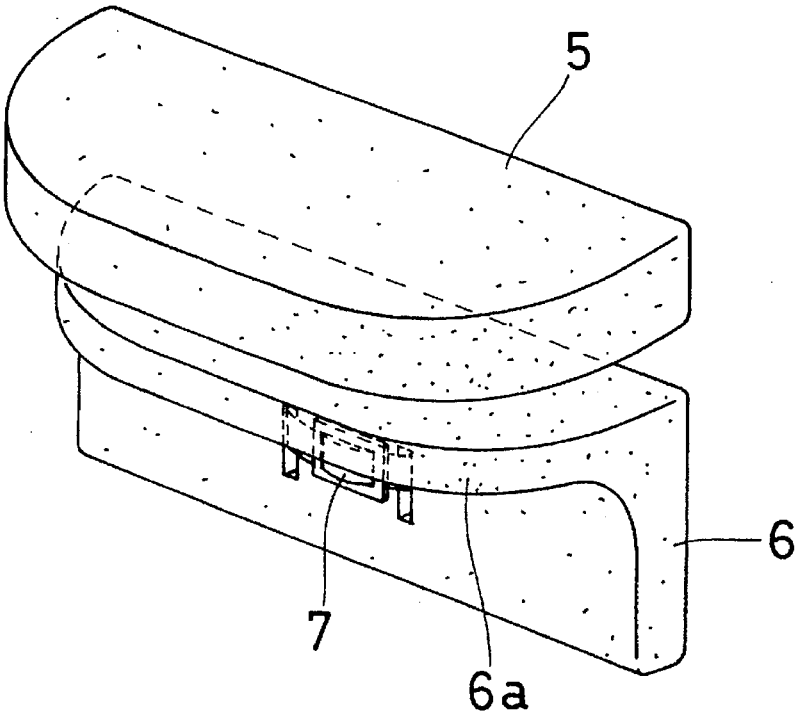
FIG. 3 is a perspective view of a seat member included in the waist bag shown in FIG. 1.

In FIGS. 1 to 3 showing a waist bag usable as a baby holder, the reference numeral 1 denotes a bag body having opposite sides secured to a waist belt 2 which will be fastened to a User's waist. The waist belt 2 is adjustable in length, and has a buckle or the like 3 operable to wear or take off this waist bag.

The bag body 1 is composed of a rear sheet 1*a* rectangular and long sideways, top and bottom sheets 1*b* and 1*c* respectively extending from upper and lower edges of the rear sheet, a front sheet 1*d* defining front and side faces of the bag body. A front portion protrudes forward from the bag body which is generally D-shaped as a whole in cross section.

A lining cloth 4 secured in the bag body extends under and in parallel with the top sheet 1*b* thereof so as to define a space. A plate core 5 placed in this space thus extends along the top sheet 1*b*. A waist pad 6 disposed vertically in front of the rear sheet 1*a* is secured thereto by a fastening band 7. The plate core 5 and the waist pad 6 constitute a seat member. A horizontal portion 6*a* protruding from an upper end of the waist pad 6 extends along the lower surface of the plate core 5, such that the waist pad is of a reversed-L shape in cross section.

The plate core 5 and the waist pad 6, both as parts of the seat member, are made of a hard polystyrol foam or the like plastics.

A mouth 8 closable with a zipper is formed in a frontal portion of the bag body 1. The mouth 8 is arch-shaped and has a central region formed in an upper middle portion of the front sheet 1*d*. Side or feet regions of the mouth extend from the central region towards lower and rear ends of the opposite sides of the bag body. Each side region of the mouth terminates at a location close to a boundary between the front sheet 1*d* and the rear sheet 1*a*. Such a design of the mouth is important and advantageous in that when the zipper is unfastened, the front sheet 1*d* can swing almost entirely together with the bottom sheet 1*c* backward and downward about a rear end thereof, as shown with the phantom lines in FIG. 2, whereby the main mouth 8 opens wide.

A pocket 9 for accommodation of small articles is provided on the front face of the front sheet 1*d*. A mouth 10 is formed at the top of this pocket and also openably closed with a zipper. The pocket 9 may be designed larger than that shown in the drawings, such that an area of the front sheet. 1*d* located below the main mouth 8 is covered by the pocket. In this case, the pocket's mouth 10 will extend in parallel with the main mouth 8.

Further connected to the bag body 1 is a shoulder strap 11 which will suspend from a user's shoulder or neck so that the user can hold a baby in its safe position. The shoulder strap has a loop-shaped upper portion and a Y-shaped lower end. The lower end is placed in the bag body 1 through the central region of the main mouth 8, and is secured to an inner surface of the top sheet 1*b*. An extension from the lower end extends between the lining cloth 4 and the plate core's horizontal portion 6*a*, and sewed to an inner surface of the rear sheet 1*a*. The reference numerals 12 denotes a shoulder pad attached to the shoulder strap, which further has a buckle 13, an auxiliary strap 14 and a backing 15.

The shoulder strap 11 may separably engage with the bag body 1, by means of a proper connector. In such a modification, the shoulder strap can be removed from the bag body so that the latter serves only as the waist bag.

In use of the waist bag usable as a baby holder provided herein, the user will fix the waist belt 2 at first to his or her waist before sitting a baby down on the bag body 1 in a forward- or rearward-directed position. The user will then suspend the shoulder strap 11 from his or her shoulder to hold the baby in safe position.

The weight of baby will be loaded in part on the user's waist portion in which the waist pad 6 of the seat member is in contact. The load will further be borne partially by the periphery of the user's waist through the waist band 2 and also partially by the shoulder through the shoulder strap 11, thus distributing the load of baby's weight.

Figure 4:
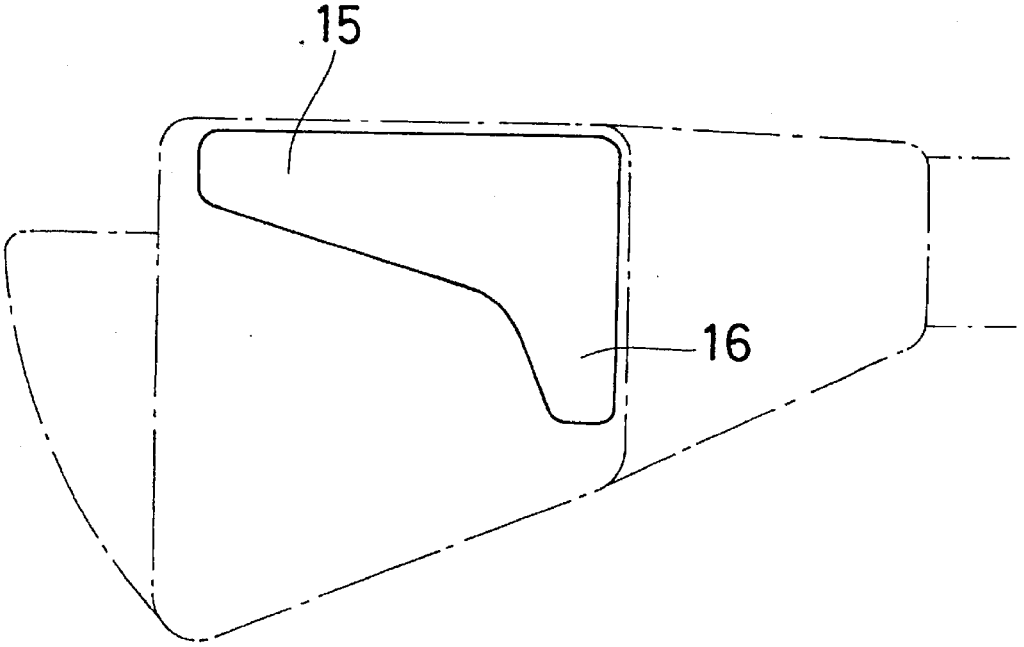
FIG. 4 is a side view of a modified seat member.

In the described embodiment, the seat member is of the separate type consisting of the plate core 5 and the waist pad 6. In a modification shown in FIG. 4, a one-piece molded seat member is composed of a core portion 15 and a waist pad portion 16. However, the separate type seat member is more preferable for a broader distribution of load. This is because the core 5 can move a little relative to the pad 6 so as to fit on the user's physical figure, whereby load concentration on a narrow region of the user's waist is avoided rendering the waist bag more comfortable in use to hold a baby.

The shoulder strap 11 may be placed in the bag body 1 through the mouth 8, so that the bag is used as an ordinary waist bag when it becomes unnecessary for the user to carry his or her baby.

In summary, the waist bag provided herein comprises the bag body in which the plate core 5 and the waist pad 6 are disposed so that the weight of a baby sitting on the bag body 1 can be borne in part by the user's waist region through the pad. Therefore, the load imparted to the user through the waist belt 2 and the shoulder strap 11 is reduced, and thus the user is protected from fatigue and oppressive pain even when the bag is used continuously for a long time.

Because the arch-shaped mouth 8 formed in the bag body 1 extends from the upper middle portion of the front sheet to the lower and rear side portions thereof, the seat member will not prevent the mouth from opening wide to facilitate an easier taking in and out of the shoulder strap and small articles.

According to the accompanying claim 2, distribution of load is improved. The waist bag can be of a simpler structure according to claim 3, can be lighter in weight according to claim 4, and can be convenient for the user to put small articles in the pocket 9 as defined in claim 5 when the shoulder strap 11 is in the bag body 1.

What is claimed is:

1. A waist bag usable as a baby holder, comprising:

a bag body having a top sheet, a front sheet, a bottom sheet, and a rear sheet; a waist belt attached to the bag body; a seat member disposed in and connected to the bag body; a Y-shaped shoulder strap; and a mouth formed in the bag body;

the seat member having a horizontal plate core extending along the top sheet and a vertical waist pad extending along the rear sheet;

the mouth is arch-shaped with a central region formed in an upper middle portion of the front sheet, and side regions which extend from the central region to a lower rear corner of the front sheet at a first edge formed by a lowermost edge of the rear sheet and a rearmost edge of the bottom sheet, whereby the front sheet pivotally swings together with the bottom sheet downward and backward about said first edge such that the mouth opens wide; and the shoulder strap is capable of being suspended from a user's shoulder when the user holds a baby seated on the bag body and has a lower end secured to an inner surface of a central portion of the top sheet, so as to be taken from the bag body, through the mouth's middle region.

2. A waist bag as defined in claim 1, wherein the plate core and the waist pad are separate parts of the seat member, the plate core is flat and placed in a space defined between the top sheet and a lining cloth secured in the bag body and extending under and in parallel with the top sheet, and the waist pad disposed vertically in front of the rear sheet is secured thereto by a fastening band and has a horizontal portion protruding from an upper end of the waist pad so as to extend along the lower surface of the plate core, such that the waist pad is of a reversed L shape in cross section.

3. A waist bag as defined in claim 1, wherein the seat member comprises the plate core formed integral with the waist pad so as to be of a reversed L shape in cross section.

4. A waist bag as defined in claim 1, 2 or 3, wherein the seat member is made of a plastic foam.

5. A waist bag as defined in claim 1, 2 or 3, further comprising a pocket formed in front of and integral with the front sheet, for accommodation of small articles.

6. A waist bag as defined in claim 4, further comprising a pocket formed in front of and-integral with the front sheet, for accommodation of small articles.

7. A waist bag as defined in claim 1, wherein the plate core and the vertical waist pad form a reversed L shape in cross section with the vertical waist pad.

8. A waist bag as defined in claim 1, wherein the vertical waist pad extends vertically substantially the height of the rear sheet.

9. A waist bag as defined in claim 7, wherein the plate core and the vertical waist pad are formed from two separate pieces.

10. A waist bag as defined in claim 1, wherein the mouth extends from a position proximate the lower end of the vertical waist pad to a position proximate a front end of the plate core.

11. A waist bag as defined in claim 1, wherein the plate core and the waist pad are separate parts of the seat member, the plate core is flat and placed in a space between the top sheet and the waist pad, the waist pad is secured to the rear sheet and has a horizontal portion protruding from an upper end of the waist pad extending along the lower surface of the plate core, such that the waist pad is of a reversed L shape in cross section.

* * * * *